US009969466B2

(12) United States Patent
Vandenworm et al.

(10) Patent No.: US 9,969,466 B2
(45) Date of Patent: May 15, 2018

(54) METHOD FOR OPERATING FLOATING DRILLER

(71) Applicant: Jurong Shipyard PTE LTD., Singapore (SG)

(72) Inventors: Nicolaas Johannes Vandenworm, Houston, TX (US); John William Beck, III, Houston, TX (US)

(73) Assignee: Jurong Shipyard PTE Ltd., Singapore (SG)

( * ) Notice: Subject to any disclaimer, the term of this patent is extended or adjusted under 35 U.S.C. 154(b) by 0 days. days.

(21) Appl. No.: 15/821,158

(22) Filed: Nov. 22, 2017

(65) Prior Publication Data

US 2018/0093744 A1 Apr. 5, 2018

Related U.S. Application Data

(63) Continuation-in-part of application No. 15/798,078, filed on Oct. 30, 2017, which is a continuation of application No. 15/705,073, filed on Sep. 14, 2017, which is a continuation of application No. 15/522,076, filed as application No. PCT/US2015/057397 on Oct. 26, 2015, which is a (Continued)

(51) Int. Cl.

| | |
|---|---|
| ***B63B 35/44*** | (2006.01) |
| ***B63B 21/50*** | (2006.01) |
| *B63B 21/00* | (2006.01) |
| *B63B 39/02* | (2006.01) |
| *B63B 1/04* | (2006.01) |

(52) U.S. Cl.
CPC ..... *B63B 21/50* (2013.01); *B63B 1/041* (2013.01); *B63B 39/02* (2013.01); *B63B 2021/003* (2013.01); *B63B 2035/4473* (2013.01)

(58) Field of Classification Search
CPC ..... B63B 35/7923; B63B 35/44
See application file for complete search history.

(56) References Cited

U.S. PATENT DOCUMENTS 2,156,635 A 5/1939 Mascuch et al.
3,041,639 A 7/1962 Atlas
(Continued)

FOREIGN PATENT DOCUMENTS

WO WO2009136799 A1 11/2002
WO WO2012005587 A1 1/2012

*Primary Examiner* — Stephen P Avila
(74) *Attorney, Agent, or Firm* — Buskop Law Group, P.C.; Wendy Buskop

(57) ABSTRACT

A method for operating floating vessel wherein the floating vessel comprises a hull having: a bottom surface, a top deck surface, at least two connected sections engaging between the bottom surface and the top deck surface, and at least one fin extending from the hull with an upper fin surface sloping towards the bottom surface and secured to and extending from the hull, the at least one fin configured to provide hydrodynamic performance. The at least two connected sections extend downwardly from the top deck surface toward the bottom surface. The at least two connected sections contain at least two of: an upper portion in section view with a sloping side extending from the top deck section, a cylindrical neck section in profile view, and a lower conical section in profile view with a sloping side extending from the cylindrical neck section.

13 Claims, 7 Drawing Sheets

Related U.S. Application Data continuation-in-part of application No. 14/524,992, filed on Oct. 27, 2014, now abandoned, which is a continuation-in-part of application No. 14/105,321, filed on Dec. 13, 2013, now Pat. No. 8,869,727, which is a continuation-in-part of application No. 13/369,600, filed on Feb. 9, 2012, now Pat. No. 8,662,000, which is a continuation-in-part of application No. 12/914,709, filed on Oct. 28, 2010, now Pat. No. 8,251,003.

(60) Provisional application No. 61/259,201, filed on Nov. 8, 2009, provisional application No. 61/262,533, filed on Nov. 18, 2009, provisional application No. 61/521,701, filed on Aug. 9, 2011.

(56) References Cited

U.S. PATENT DOCUMENTS 3,352,118 A * 11/1967 Burkhardt ..... E02L 317/0017 114/219
4,282,822 A 8/1981 Jackson
4,502,551 A 4/1982 Rule
4,446,808 A 5/1984 Colin
4,606,673 A 12/1984 Daniell
4,549,835 A 10/1985 Ando et al.
4,640,214 A 2/1987 Bruns
4,679,517 A 7/1987 Kramer
4,984,935 A 1/1991 de Oliveira Filho et al.
5,573,353 A 11/1996 Recalde
6,761,508 B1 * 7/2004 Haun ..... B63B 35/4413 114/264
6,945,736 B2 12/2005 Smedel
7,958,835 B2 * 6/2011 Srinivasan ..... B63B 35/44 114/125
8,251,003 B2 8/2012 Vandenworm
8,662,000 B2 3/2014 Vandenworm
9,079,644 B2 7/2015 Aarsnes
9,340,264 B2 5/2016 Syvertesen
2009/0126616 A1 5/2009 Srinivasan
2013/0133563 A1 5/2013 Kroecker
2015/0175245 A1 6/2015 Huang
2015/0175246 A1 6/2015 Haung
2015/0344114 A1 12/2015 Haung

* cited by examiner

FIG. 7
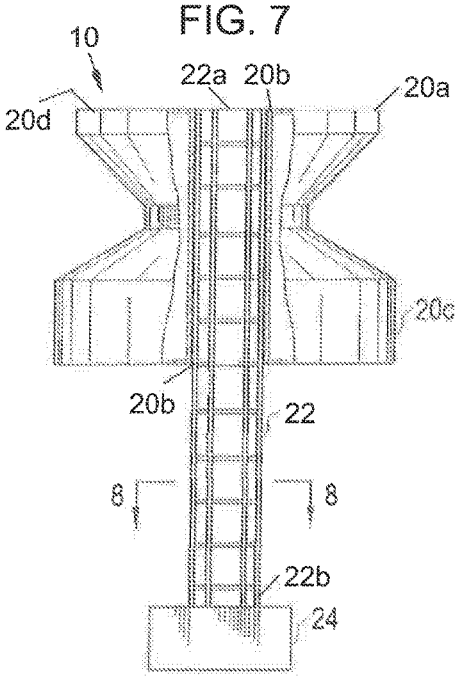
FIG. 9
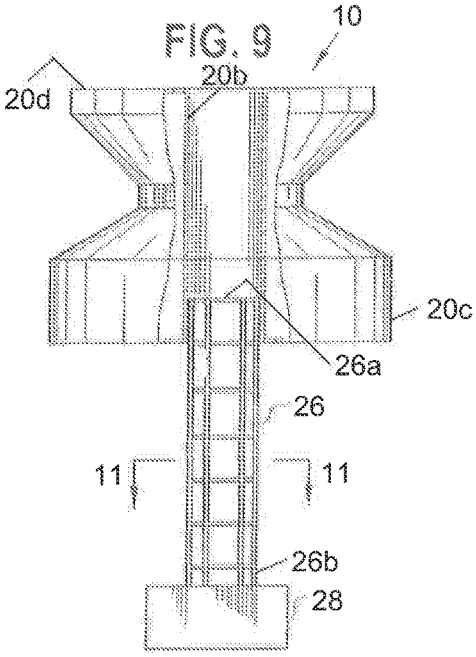
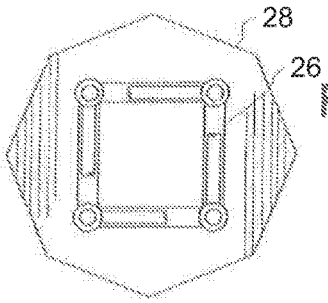
FIG.10
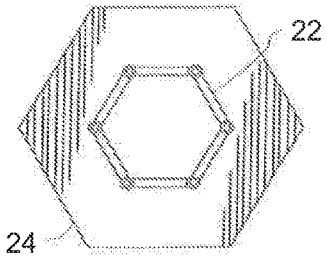
FIG. 8
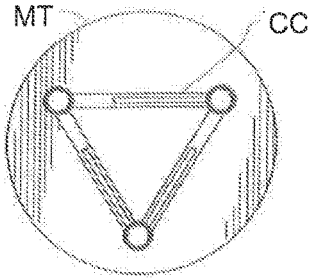
FIG. 11

METHOD FOR OPERATING FLOATING DRILLER

CROSS REFERENCE TO RELATED APPLICATIONS

The present application is a Continuation in Part and claims priority to co-pending U.S. patent application Ser. No. 15/798,078 filed on Oct. 30, 2017 entitled "FLOATING DRILLER," which is a Continuation of U.S. patent application Ser. No. 15/705,073 filed Sep. 14, 2017 entitled "BUOYANT STRUCTURE" which is a continuation of U.S. patent application Ser. No. 15/522,076 filed on Apr. 26, 2017 entitled "BUOYANT STRUCTURE," which claims priority to and the benefit of co-pending National Phase Application. PCT/US2015/057397 filed on Oct. 26, 2015 with claims priority of U.S. patent application Ser. No. 14/524,992 filed on Oct. 27, 2014, entitled "BUOYANT STRUCTURE," which is a Continuation in Part of issued U.S. patent application Ser. No. 14/105,321 filed on Dec. 13, 2013, entitled "BUOYANT STRUCTURE," issued as U.S. Pat. No. 8,869,727 on Oct. 28, 2014, which is a Continuation in Part of issued U.S. patent application Ser. No. 13/369,600 filed on Feb. 9, 2012, entitled "STABLE. OFFSHORE FLOATING DEPOT," issued as U.S. Pat. No. 8,662,000 on Mar. 4, 2014, which is a Continuation in Part of issued U.S. patent application Ser. No. 12/914,709 filed on Oct. 28, 2010, issued as U.S. Pat. No. 8,251,003 on Aug. 28, 2012, which claims the benefit of U.S. Provisional Patent Application Ser. No. 61/259,201 filed on Nov. 8, 2009 and U.S. Provisional Patent Application Ser. No. 61/262,533 filed on Nov. 18, 2009; and claims the benefit of U.S. Provisional Patent Application Ser. No. 61/521,701 filed on Aug. 9, 2011. These references are hereby incorporated in their entirety.

FIELD

The present embodiments generally relate to a floating vessel.

BACKGROUND

This present invention pertains to floating production, storage and offloading (FPSO) vessels and more particularly to hull designs and offloading systems for a floating drilling, production, storage and offloading (FDPSO) vessel.

The present embodiments meet these needs.

BRIEF DESCRIPTION OF THE DRAWINGS

The detailed description will be better understood in conjunction with the accompanying drawings as follows:

FIG. 7 is a side elevation of an alternative embodiment of an FPSO vessel, according to the present invention, showing a center column received in a bore through the hull of the FPSO vessel.

FIG. 8 is a cross section of the center column of FIG. 7, as seen along the line 8-8.

FIG. 9 is a side elevation of the FPSO vessel of FIG. 7 showing an alternative embodiment of the center column, according to the present invention.

FIG. 10 is a cross section of the center column of FIG. 9, as seen along the line 11-11.

FIG. 11 is an alternative embodiment of a center column and a mass trap as would be seen along the line 11-11 in FIG. 9, according to the present invention.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present invention provides a floating platform, storage and offloading (FPSO) vessel with several alternative hull designs, several alternative center column design and a moveable hawser system for offloading, which allows a tanker to weathervane over a wide arc with respect to the FPSO vessel.

The invention relates to a method for operating a uniquely shaped floating vessel wherein the floating vessel has a hull having: a bottom surface; a top deck surface; and at least two connected sections engaging between the bottom surface and the top deck surface.

The at least two connected sections extend downwardly from the top deck surface toward the bottom surface.

The at least two connected sections are at least two of: an upper portion in section view with a sloping side extending from the top deck section; a cylindrical neck section in profile view; and a lower conical section in profile view with a sloping side extending from the cylindrical neck section; and at least one fin extending from the hull with an upper fin surface sloping towards the bottom surface and secured to and extending from the hull, the at least one fin configured to provide hydrodynamic performance.

Turning now to the Figures, the unique hull can be viewed.

Figure 1:
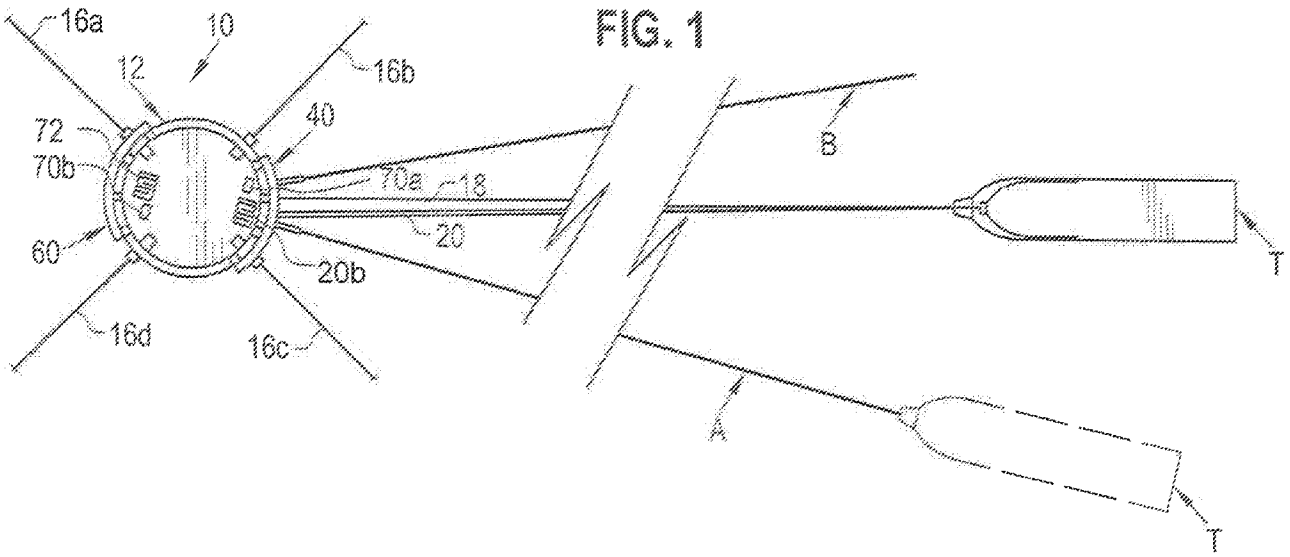
FIG. 1 is a top plan view of an FPSO vessel, according to the present invention, and a tanker moored to the FPSO vessel.
Figure 2:
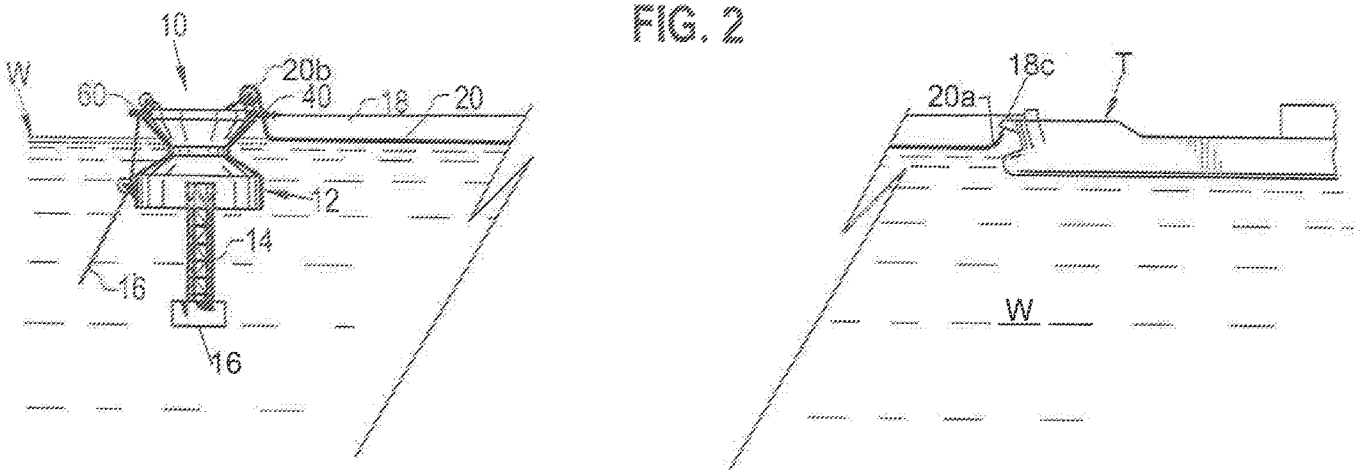
FIG. 2 is a side elevation of the FPSO vessel of FIG. 1

An FPSO vessel 10 is shown in a plan view in FIG. 1 and in a side elevation in FIG. 2, according to the present invention.

FPSO vessel 10 has a hull 12, and a center column 14 can be attached to hull 12 and extend downwardly.

FPSO vessel 10 floats in water W and can be used in the production, storage and/or offloading of resources extracted from the earth, such as hydrocarbons including crude oil and natural gas and minerals such as can be extracted by solution mining.

FPSO vessel 10 can be assembled onshore using known methods, which are similar to shipbuilding, and towed to an offshore location, typically above an oil and/or gas field in the earth below the offshore location.

Anchor lines 16*a,* 16*b,* 16*c* and 16*d,* which would be fastened to anchors in the seabed that are not shown, moor FPSO vessel 10 in a desired location. The anchor lines are referred to generally as anchor lines 16, and elements described herein that are similarly related to one another will share a common numerical identification and be distinguished from one another by a suffix letter.

In a typical application for FPSO vessel 10, crude oil is produced from the earth below the seabed below vessel 10, transferred into and stored temporarily in hull 12, and offloaded to a tanker T for transport to onshore facilities. Tanker T is moored temporarily to FPSO vessel 10 during the offloading operation by a hawser 18. A hose 20 is extended between hull 12 and tanker T for transfer of crude oil and/or another fluid from FPSO vessel 10 to tanker T.

Figure 3:
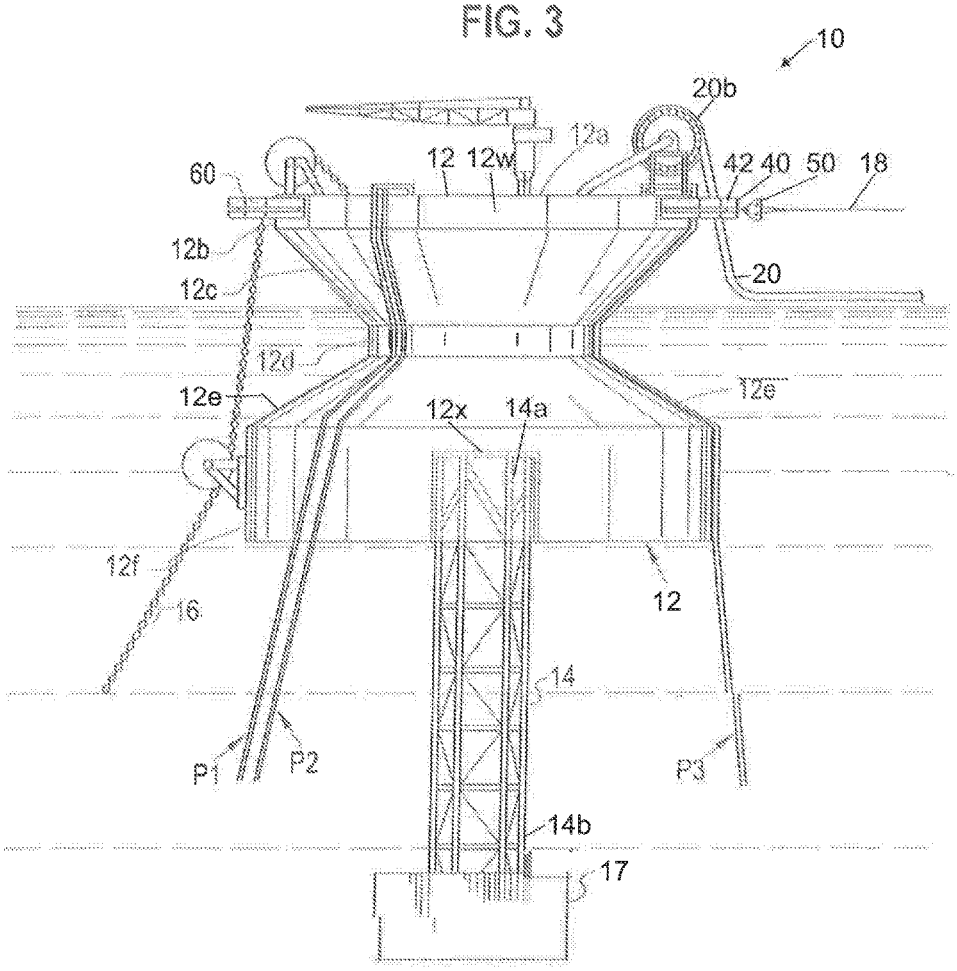
FIG. 3 is an enlarged and more detailed version of the side elevation of the FPSO vessel shown in FIG. 2.
Figure 4:
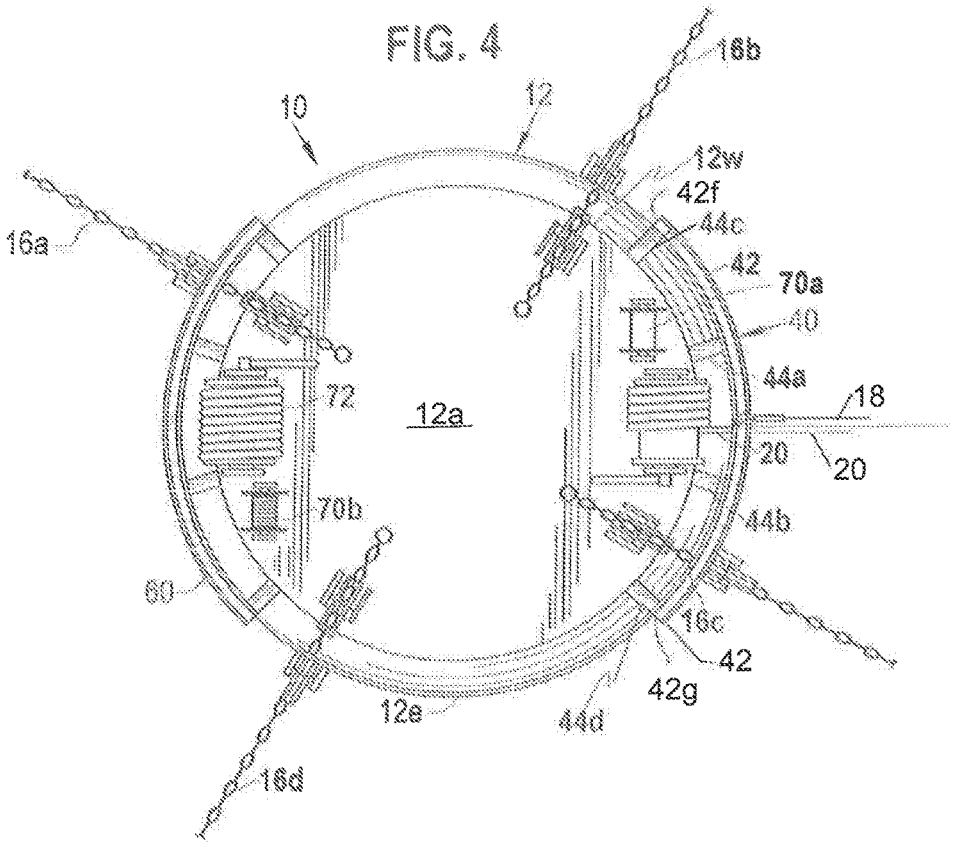
FIG. 4 is an enlarged and more detailed version of the top plan view of the FPSO vessel shown in FIG. 1

FIG. 3 is a side elevation of FPSO vessel 10, FIG. 4 is a top plan view of FPSO vessel 10, and each view is larger and shows more detail than the corresponding FIGS. 2 and 1, respectively. Hull 12 of FPSO vessel 10 has a circular top deck surface 12*a,* an upper cylindrical portion 12*b* extending downwardly from deck surface 12*a,* an upper conical section 12*c* extending downwardly from upper cylindrical portion 12*b* and tapering inwardly, a cylindrical neck section 12*d* extending downwardly from upper conical section 12*c,* a lower conical section 12*e* extending downwardly from neck section 12*d* and flaring outwardly, and a lower cylindrical section 12*f* extending downwardly from lower conical section 12*e.* Lower conical section 12*e* is described herein as having the shape of an inverted cone or as having an inverted conical shape as opposed to upper conical section 12*c,* which is described herein as having a regular conical shape. FPSO vessel 10 preferably floats such that the surface of the water intersects regular, upper conical section 12*c,* which is referred to herein as the waterline being on the regular cone shape.

FPSO vessel 10 is preferably loaded and/or ballasted to maintain the waterline on a bottom portion of regular, upper conical section 12*c.* When FPSO vessel 10 is installed and floating properly, a cross-section of hull 12 through any horizontal plane has preferably a circular shape.

Hull 12 can be designed and sized to meet the requirements of a particular application, and services can be requested from Maritime Research Institute (Marin) of The Netherlands to provide optimized design parameters to satisfy the design requirements for a particular application.

In this embodiment, upper cylindrical section 12*b* has approximately the same height as neck section 12*d,* while the height of lower cylindrical section 12*f* is about 3 or 4 times greater than the height of upper cylindrical section 12*b.* Lower cylindrical section 12*f* has a greater diameter than upper cylindrical section 12*b.* Upper conical section 12*c* has a greater height than lower conical section 12*e.*

Figure 5:
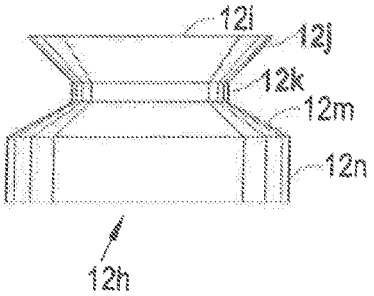
FIG. 5 is a side elevation of an alternative embodiment of the hull for an FPSO vessel, according to the present invention.
Figure 6:
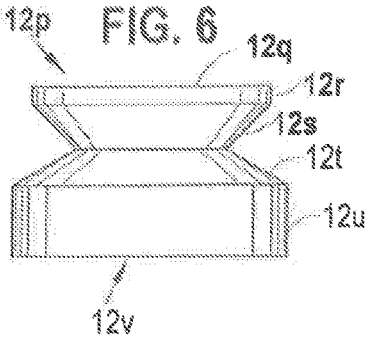
FIG. 6 is a side elevation of an alternative embodiment of the hull for an FPSO vessel, according to the present invention.

FIGS. 5 and 6 are side elevations showing alternative designs for the hull.

FIG. 5 shows a hull 12*h* that has a circular top deck surface 12*i,* which would be essentially identical to top deck surface 12*a,* on a top portion of an upper conical section 12*j* that tapers inwardly as it extends downwardly.

A cylindrical neck section 12*k* is attached to a lower end of upper conical section 12*j* and extends downwardly from upper conical section 12*j.* A lower conical section 12*m* is attached to a lower end of neck section 12*k* and extends downwardly from neck section 12*k* while flaring outwardly. A lower cylindrical section 12*n* is attached to a lower end of lower conical section 12*m* and extends downwardly from lower conical section 12*m.* A significant difference between hull 12*h* and hull 12 is that hull 12*h* does not have an upper cylindrical portion corresponding to upper cylindrical portion 12*b* in hull 12. Otherwise, upper conical section 12*j* corresponds to upper conical section 12*c;* neck section 12*k* corresponds to neck section 12*d;* lower conical section 12*m* corresponds to lower conical section 12*e;* and lower cylindrical section 12*n* corresponds to lower cylindrical section 12*f.*

Each of lower cylindrical section 12*n* and lower cylindrical section 12*f* has a circular bottom deck that is not shown, but which is similar to circular top deck surface 12*a*, except center section 14 extends downwardly from the circular bottom deck.

FIG. 6 is a side elevation of a hull 12*p,* which has a top deck 12*q* that looks like top deck surface 12*a*. An upper cylindrical section 12*r* extends downwardly from top deck 12*q* and corresponds to upper cylindrical section 12*b.*

An upper conical section 12*s* is attached to a lower end of upper cylindrical section 12*r* and extends downwardly while tapering inwardly. Upper conical section 12*s* corresponds to upper conical section 12*c* in FIG. 1. Hull 12*p* in FIG. 6 does not have a cylindrical neck section that corresponds to cylindrical neck section 12*d* in FIG. 3.

Instead, an upper end of a lower conical section 12*t* is connected to a lower end of upper conical section 12*s*, and lower conical section 12*t* extends downwardly while flaring outwardly. Lower conical section 12*t* in FIG. 6 corresponds to lower conical section 12*e* in FIG. 3.

A lower cylindrical section 12*u* is attached at an upper end, such as by welding, to a lower end of lower conical section 12*t* and extends downwardly, essentially corresponding in size and configuration to lower cylindrical section 12*f* in FIG. 3. A bottom plate 12*v* (not shown) encloses a lower end of lower cylindrical section 12*u,* and the lower end of hull 12 in FIG. 3 and hull 12*h* in FIG. 5 are similarly enclosed by a bottom plate, and each of the bottom plates can be adapted to accommodate a respective center column corresponding to center column 14 in FIG. 3.

Turning now to FIGS. 7-11, alternative embodiments for a center column are illustrated. FIG. 7 is a side elevation of an FPSO vessel 10 partially cut away to show a center column 22, according to the present invention. FPSO vessel 10 has a top deck surface 20*a* that has an opening 20*h* through which center column 22 can pass. In this embodiment, center column 22 can be retracted, and an upper end 22*a* of center column 22 can be raised above top deck surface 20*a*. If center column 22 is fully retracted, FPSO vessel 10 can be moved through shallower water than if center column 22 is fully extended. U.S. Pat. No. 6,761,508, issued to Haun, provides further details relevant to this and other aspects of the present invention and is incorporated by reference in its entirety.

FIG. 7 shows center column 22 partially retracted, and center column 22 can be extended to a depth where upper end 22*a* is located within a lowermost cylindrical portion 20*c* of FPSO vessel 10. FIG. 8 is a cross-section of center column 22 as seen along the line 8-8 in FIG. 7, and FIG. 8 shows a plan view of a mass trap 24 located on a bottom end 22*b* of center column 22. Mass trap 24, which is shown in this embodiment as having a hexagonal shape in its plan view, is weighted with water for stabilizing FPSO 10 as it floats in water and is subject to wind, wave, current and other forces. Center column 22 is shown in FIG. 8 as having a hexagonal cross-section, but this is a design choice.

FIG. 9 is a side elevation of the FPSO vessel 10 of FIG. 7 partially cut away to show a center column 26, according to the present invention. Center column 26 is shorter than center column 22 in FIG. 7. An upper end 26*a* of center column 26 can be moved up or down within opening 20*b* in FPSO vessel 10, and with center column 26, FPSO vessel 10 can be operated with only a couple or a few meters of center column 26 protruding below the bottom of FPSO vessel 20.

A mass trap 28, which may be tilled with water to stabilize FPSO vessel 10, is secured to a lower end 26*b* of center column 26.

FIG. 10 is a cross-section of center column 26 as seen along the line 11-11 in FIG. 9.

In this embodiment of a center column, center column 26 has a square cross-section, and mass trap 28 has an octagonal shape in the plan view of FIG. 10.

In an alternative embodiment of the center column in FIG. 9 as seen along the line 11-11, a center column CC and a mass trap MT are shown in FIG. 11 in a top plan view. In this embodiment, center column CC has a triangular shape in a transverse cross-section, and mass trap MT has a circular shape in a top plan view.

Returning to FIG. 3, FPSO vessel hull 12 has a cavity or recess 12*x* shown in phantom lines, which is a centralized opening into a bottom portion of lower cylindrical section 12*f* of FPSO vessel hull 12. An upper end 14*a* of central column 14 protrudes into essentially the full depth of recess 12*x*.

In the embodiment illustrated in FIG. 3, center column 14 is effectively cantilevered from the bottom of lower cylindrical section 12*f*, much like a post anchored in a hole, but with the center column 14 extending downwardly into the water upon which FPSO vessel hull 12 floats. A mass trap 17 for containing water weight to stabilize hull 12 is attached to a lower end 14*b* of center column 14.

Various embodiments of a center column have been described; however, the center column is optional and can be eliminated entirely or replaced with a different structure that protrudes from the bottom of the FPSO vessel and helps to stabilize the vessel.

One application for FPSO vessel 10 illustrated in FIG. 3 is in production and storage of hydrocarbons such as crude oil and natural gas and associated fluids and minerals and other resources that can be extracted or harvested from the earth and/or water. As shown in FIG. 3, production risers P1, P2 and P3 are pipes or tubes through which, for example, crude oil may flow from deep within the earth to FPSO vessel 10, which has significant storage capacity within tanks within hull 12.

In FIG. 3, production risers P1, P2 and P3 are illustrated as being located on an outside surface of hull 12, and production would flow into hull 12 through openings in top deck surface 12*a*. An alternative arrangement is available in FPSO vessel 10 shown in FIGS. 7 and 9, where it is possible to locate production risers within opening 20*b* that provides an open throughway from the bottom of FPSO vessel 10 to the top of FPSO vessel 10. Production risers are not shown in FIGS. 7 and 9, but can be located on an outside surface of the hull or within opening 20*b*. An upper end of a production riser can terminate at a desired location with respect to the hull so that production flows directly into a desired storage tank within the hull.

FPSO vessel 10 of FIGS. 7 and 9 can also be used to drill into the earth to discover or to extract resources, particularly hydrocarbons such as crude oil and natural gas, making the vessel a floating drilling, production, storage and offloading (FDPSO) vessel.

For this application, mass tank MT, 24 or 28 would have a central opening from a top surface to a bottom surface through which drill string can pass, which is a structural design that can also be used for accommodating production risers within opening 20*b* in FDPSO vessel 10. A derrick (not shown) would be provided on a top deck surface 20*d* of FPSO vessel 10 for handling, lowering, rotating and raising drill pipe and an assembled drill string, which would extend downwardly from the derrick through opening 20*b* in FPSO vessel 10, through an interior portion of center column 22 or 26, through a central opening (not shown) in mass tank 24 or 28, through the water and into the seabed below.

After drilling is successfully completed, production risers can be installed, and the resource, such as crude oil and/or natural gas, can be received and stored in tankage located within the FPSO vessel. U.S. Patent Application Publication No. 2009/0126616, which lists Srinivasan as a sole inventor, describes an arrangement of tankage in the hull of an FPSO vessel for oil and water ballast storage and is incorporated by reference. In one embodiment of the present invention, a heavy ballast, such as a slurry of hematite and water, can be used, preferably in outer ballast tanks. A slurry is preferred, preferably one part hematite and three parts water, but a permanent ballast, such as a concrete could be used. A concrete with a heavy aggregate, such as hematite, barite, limonite, magnetite, steel punching and shot, can be used, but preferably a high-density material is used in a slurry form. Drilling, production and storage aspects of the floating drilling, production, storage and offloading vessel of the present invention have thus been described, which leaves the offloading function of an FDPSO vessel.

Turning to the offloading function of the HMSO vessel of the present invention, FIGS. 1 and 2 illustrate transport tanker T moored to FPSO vessel 10 by hawser 18, which is a rope or a cable, and hose 20 has been extended from FPSO vessel 10 to tanker T. FPSO vessel 10 is anchored to the seabed through anchor lines 16*a*, 16*b*, 16*c* and 16*d*, while tanker T's location and orientation is effected by wind direction and force, wave action and force and direction of current.

Consequently, tanker T weathervanes with respect to FPSO vessel 10 because its bow is moored to FPSO vessel 10 while its stem moves into an alignment determined by a balance of forces. As forces due to wind, wave and current change, tanker T may move to the position indicated by phantom line A or to the position indicated by phantom line B. Tugboats or a temporary anchoring system, neither of which is shown, can be used to keep tanker T a minimum, safe distance form FPSO vessel 10 in case of a change in net forces that causes tanker T to move toward FPSO vessel 10 rather than away from FPSO vessel 10 so that hawser 18 remains taut.

If wind, wave, current (and any other) forces remained calm and constant, tanker T would weath.ervane into a position in which all forces acting on the tanker were in balance, and tanker T would remain in that position. However, that is generally not the case in a natural environment. Particularly, wind direction and speed or force changes from time to time, and any change in the forces acting on tanker T cause tanker T to move into a different position in which the various forces are again in balance. Consequently, tanker T moves with respect to FPSO vessel 10 as various forces acting upon tanker T change, such as the forces due to wind wave and current action.

Figure 12:
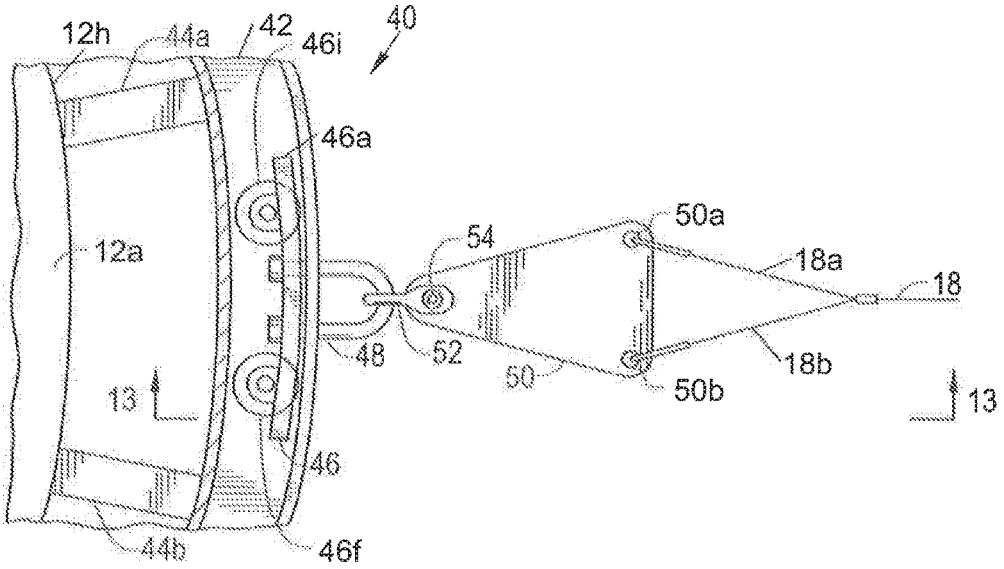
FIG. 12 is a top plan view of a moveable hawser connection, according to the present invention.
Figure 13:
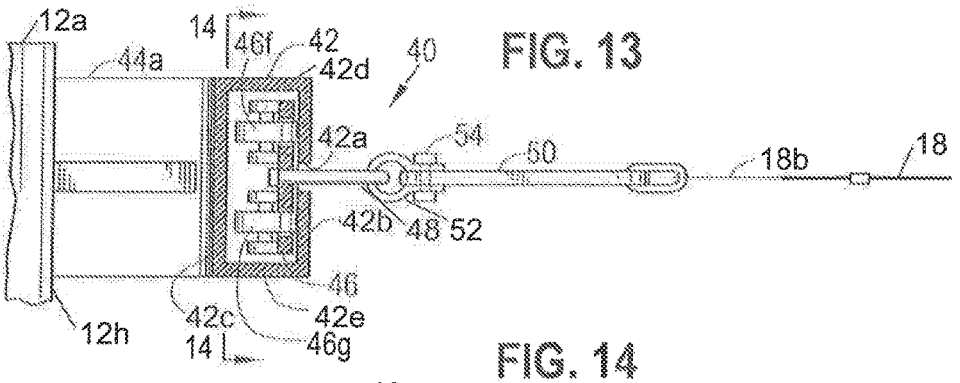
FIG. 13 is a side elevation of the moveable hawser connection of FIG. 12 in partial cross-section as seen along the line 13-13.
Figure 14:
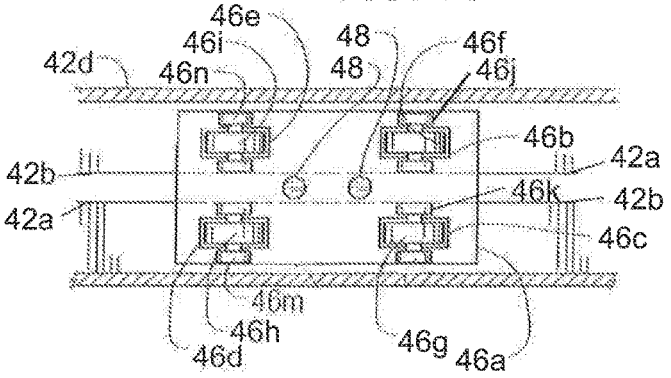
FIG. 14 is a side elevation of the moveable hawser connection of FIG. 13 in partial cross-section as seen along the line 14-14.

FIGS. 12-14, in conjunction with FIGS. 1 and 2, illustrate a moveable hawser connection 40 on the FPSO vessel, according to the present invention, which helps to accommodate movement of the transport tanker with respect to the FPSO vessel.

FIG. 12 is a plan view of moveable hawser connection 40 in partial cross-section. Moveable hawser connection 40 comprises in one embodiment a nearly fully enclosed tubular channel 42 that has a rectangular cross-section and a longitudinal slot 42*a* on a side wall 42*b* ; a set of stand-offs 44, including stand-offs 44*a* and 44*b*, that connect tubular channel 42 horizontally to an outside, upper wall 12*w* of hull 12 in FIGS. 1-4; a trolley 46 captured and moveable within tubular channel 42; a trolley shackle 48 attached to trolley 46 and providing a connection point; and a plate 50 pivotably attached to trolley shackle 48 through a plate shackle 52.

Plate 50 has a generally triangular shape with the apex of the triangle attached to plate shackle 52 through a pin 54 passing through a hole in plate shackle 50. Plate 50 has a hole 50*a* adjacent another point of the triangle and a plate hole 50*b* adjacent the final point of the triangle. Hawser 18 terminates with dual connection points 18*a* and 18*b,* which are connected to plate 50 by passing through holes 50*a* and 50*b,* respectively. Alternatively, dual ends 18*a* and 18*b*, plate 50 and/or shackle 52 can be eliminated, and hawser 18 can be connected directly to shackle 48, and other variations in how the hawser 18 is connected to trolley 46 are available.

FIG. 13 is a side elevation of moveable hawser connection 40 in partial cross-section as seen along the line 13-13 in FIG. 12. A side elevation of tubular channel 42 is shown in cross-section. Wall 42*b*, which has slot 42*a*, is a relatively tall, vertical outer wall, and an outside surface of an opposing inner wall 42*c* is equal in height.

Stand-offs 44 are attached, such as by welding, to the outside surface of inner wall 42*c*. A pair of opposing, relatively short, horizontal walls 42*d* and 42*e* extend between vertical walls 42*b* and 42*c* to complete the enclosure of tubular channel 42, except vertical wall 42*b* has the horizontal, longitudinal slot 42*a* that extends nearly the full length of tubular channel 42.

FIG. 14 is a side elevation with tubular channel 42 in partial cross-section in order to show a side elevation of trolley 46. Trolley 46 includes a base plate 46*a*, which has four rectangular openings 46*b*, 46*c*, 46*d* and 46*e*, for receiving four wheels 46*f*, 46*g*, 46*h* and 46*i*, respectively, which are mounted on four axles 46*j*, 46*k*, 46*m* and 46*n*, respectively, that are attached through stand-offs to base plate 46*a*.

Tanker T is moored to FPSO vessel 10 in FIGS. 1-4 through hawser 18, which is attached to moveable trolley 46 through plate 50 and shackles 48 and 52. As wind, wave, current and/or other forces act on tanker T, tanker T can move in an arc about FPSO vessel 10 at a radius determined by the length of hawser 18 because trolley 46 is free to roll back and forth in a horizontal plane within tubular channel 42. As best seen in FIG. 4, tubular channel 42 extends in about a 90-degree arc about hull 12 of FPSO vessel 10. Tubular channel 42 has opposing ends 42*f* and 42*g*, each of which is enclosed for providing a stop for trolley 46. Tubular channel 42 has a radius of curvature that matches the radius of curvature of outside wall 12*w* of hull 12 because standoffs 44*a*, 44*b,* 44*c* and 44*d* are equal in length. Trolley 46 is free to roll back and forth within enclosed tubular channel 42 between ends 42*f* and 42*g* of tubular channel 42. Standoffs 44*a*, 44*b*, 44*c* and 44*d* space tubular channel away from outside wall 12*w* of hull 12, and hose 20 and anchor line 16*c* pass through a space defined between outer wall 12*w* and inside wall 42*c* of tubular channel 42.

Typically, wind, wave and current forces will position tanker T in a position, with respect to FPSO vessel 10, referred to herein as downwind of the FPSO vessel 10. Hawser 18 is taut and in tension as wind, wave and current action applies a force on tanker T that attempts to move tanker T away from and downwind of stationary FPSO vessel 10. Trolley 46 comes to rest within tubular channel 42 due to a balance of forces that neutralizes a tendency for trolley 46 to move.

Upon a change in wind direction, tanker T can move with respect to FPSO vessel 10, and as tanker T moves, trolley 46 will roll within tubular channel 42 with the wheels 46*f*, 46*g*, 46*h* and 46*i* pressed against an inside surface of wall 42*b* of tubular channel 42. As the wind continues in its new, fixed direction, trolley 46 will settle within tubular channel 42 where forces causing trolley 46 to roll are neutralized.

One or more tugboats can be used to limit the motion of tanker T to prevent tanker T from moving too close to FPSO vessel 10 or from wrapping around FPSO vessel 10, such as due to a substantial change in wind direction.

For flexibility in accommodating wind direction, FPSO vessel 10 preferably has a second moveable hawser connection 60 positioned opposite of moveable hawser connection 40. Tanker T can be moored to either moveable hawser connection 40 or to moveable hawser connection 60, depending on which better accommodates tanker T downwind of FPSO vessel 10.

Moveable hawser connection 60 is essentially identical in design and construction to moveable hawser 40 with its own slotted tubular channel and trapped, free-rolling trolley car having a shackle protruding through the slot in the tubular channel. Each moveable hawser connection 40 and 60 is believed to be capable of accommodating movement of tanker T within about a 270-degree arc, so a great deal of flexibility is provided both during a single offloading operation (by movement of the trolley within one of the moveable hawser connections) and from one offloading operation to another (by being able to choose between opposing moveable hawser connections).

Wind, wave and current action can apply a great deal of force on tanker T, particularly during a storm or squall, which in turn applies a great deal of force on trolley 46, which in turn applies a great deal of force on slotted wall 42*b* (FIG. 13) of tubular channel 42. Slot 42*a* weakens wall 42*b*, and if enough force is applied, wall 42*b* can bend, possibly opening slot 42*a* wide enough for trolley 46 to be ripped out of tubular channel 42. Tubular channel 42 will need to be designed and built to withstand anticipated forces. Inside corners within tubular channel 42 may be built up for reinforcement, and it may be possible to use wheels that have a spherical shape. The tubular channel is just one means for providing a moveable hawser connection. An I-beam, which has opposing flanges attached to a central web, could be used as a rail instead of the tubular channel, with a trolley car or other rolling or sliding device trapped to, and moveable on, the outside flange. The moveable hawser connection is similar to a gantry crane, except a gantry crane is adapted to accommodate vertical forces, while the moveable hawser connection needs to be adapted to accommodate a horizontal force exerted through the hawser 18. Any type of rail, channel or track can be used in the moveable hawser connection, provided a trolley or any kind of rolling, moveable or sliding device can move longitudinally on, but is otherwise trapped on, the rail, channel or track. The following patents are incorporated by reference for all that they teach and particularly for what they teach about how to design and build a moveable connection. U.S. Pat. No. 5,595,121, entitled "Amusement Ride and Self-propelled Vehicle Therefor" and issued to Elliott et al.; U.S. Pat. No. 6,857,373, entitled "Variably Curved Track-Mounted Amusement Ride and issued to Checketts et al.; U.S. Pat. No. 3,941,060, entitled "Monorail System" and issued to Morshach; U.S. Pat. No. 4,984,523, entitled "Self-propelled Trolley and Supporting Track Structure" and issued to Dehne et al.; and U.S. Pat. No. 7,004,076, entitled "Material Handling System Enclosed Track Arrangement" and issued to Traubenkraut et al., are all incorporated by reference in their entirety for all purposes. As described herein and in the patents incorporated by reference, a variety of means can be used to resist a horizontal force, such as applied on FPSO vessel 10 through hawser 18 from tanker T, while providing lateral movement, such as by trolley 46 rolling back and forth horizontally while trapped within tubular channel 42.

Wind, waves and current apply a number of forces on the FDPSO or FPSO vessel of the present invention, which causes a vertical up and down motion or heave, in addition to other motions. A production riser is a pipe or tube that extends from a wellhead on the seabed to the FDPSO or the FPSO, which is referred to herein generally as an FPSO. The production riser can be fixed at the seabed and fixed to the FPSO. Heave on the FPSO vessel can place alternating tension and compression forces on the production riser, which can cause fatigue and failure in the production riser. One aspect of the present invention is to minimize the heave of the FPSO vessel.

Figure 15:
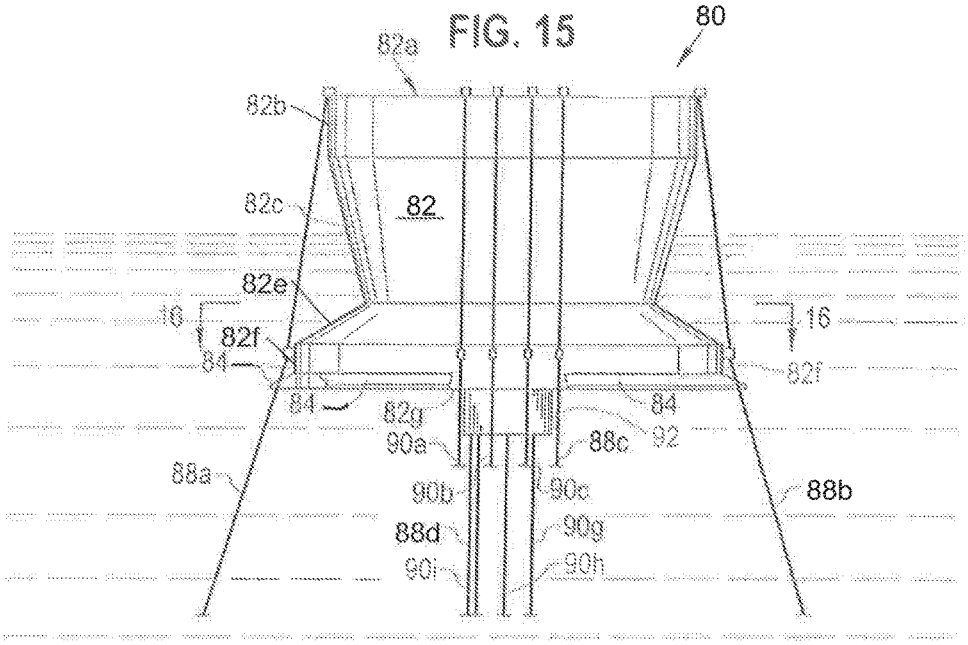
FIG. 15 is a side elevation of a vessel, according to the present invention.

FIG. 15 is a side elevation of an FDPSO or FPSO vessel 80, according to the present invention. Vessel 80 has a hull 82 and a circular top deck surface 82*a*, and a cross-section of hull 82 through any horizontal plane, while hull 82 is floating and a rest, has preferably a circular shape. An upper cylindrical section 82*b* extends downwardly from the circular top deck surface 82*a*, and an upper conical section 82*c* extends downwardly from upper cylindrical portion 82*b* and tapers inwardly. Vessel 80 could have a cylindrical neck section 82*d* extending downwardly from upper conical section 82*c*, which would make it more similar to vessel 10 in FIG. 3, but it does not. Instead, a lower conical section 82*e* extends downwardly from upper conical section 82*c* and flares outwardly. A lower cylindrical section 82*f* extends downwardly from lower conical section 82*e*. Hull 82 has a bottom surface 82*g*. Lower conical section 82*e* is described herein as having the shape of an inverted cone or as having an inverted conical shape as opposed to upper conical section 82*c*, which is described herein as having a regular conical shape.

FPSO vessel 80 is shown as floating such that the surface of the water intersects the upper cylindrical portion 82*b* when loaded and/or ballasted. In this embodiment, upper conical section 82*c* has a substantially greater vertical height than lower conical section 82*e*, and upper cylindrical section 82*b* has a slightly greater vertical height than lower cylindrical section 82*f*.

Figure 16:
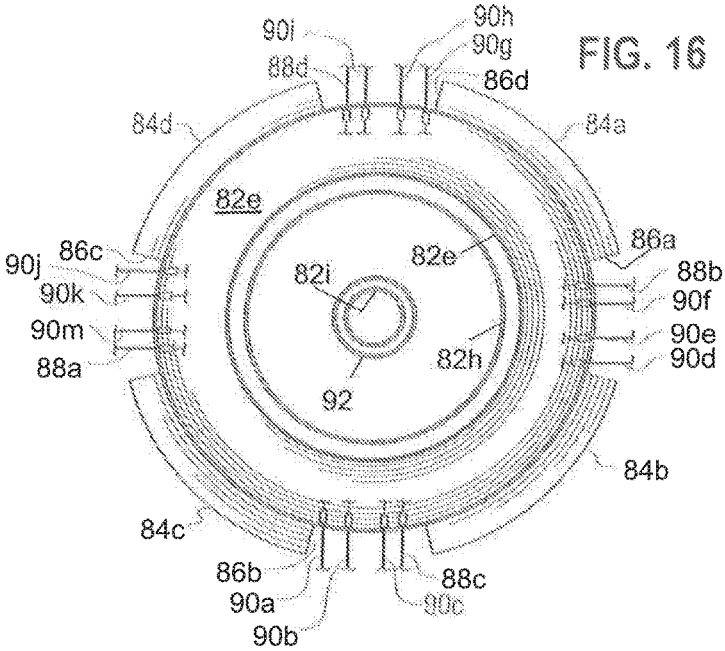
FIG. 16 is a cross section of the vessel of FIG. 15 as seen along the line 16-16 shown in cross-section.

For reducing heave and otherwise steadying vessel 80, a set of fins 84 is attached to a lower and outer portion of lower cylindrical section 82*f*, as shown in FIG. 15. FIG. 16 is a cross-section of vessel 80 as would be seen along the line 16-16 in FIG. 15. As can be seen in FIG. 16, fins 84 comprise four fin sections 84*a*, 84*b*, 84*c* and 84*d*, which are separated from each other by gaps 86*a*, 86*b*, 86*c* and 86*d* (collectively referred to as gaps 86). Gaps 86 are spaces between fin sections 84*a*, 84*b*, 84*c* and 84*d*, which provide a place that accommodates production risers and anchor lines on the exterior of hull 82, without contact with fins 84. Anchor lines 88*a*, 88*b*, 88*c* and 88*d* in FIGS. 15 and 16 are received in gaps 86*c*, 86*a*, 86*b* and 86*d*, respectively, and secure FDPSO and/or FPSO vessel 80 to the seabed. Production risers 90*a*, 90*b*, 90*c*, 90*d*, 90*e*, 90*f*, 90*g*, 90*e*, 90*g*, 90*h*, 90*i*, 90*j*, 90*k* and 90*m* are received in the gaps 86 and deliver a resource, such as crude oil, natural gas and/or a leached mineral, from the earth below the seabed to tankage within vessel 80. A center section 92 extends from bottom 82*g* of hull 82.

Figure 17:
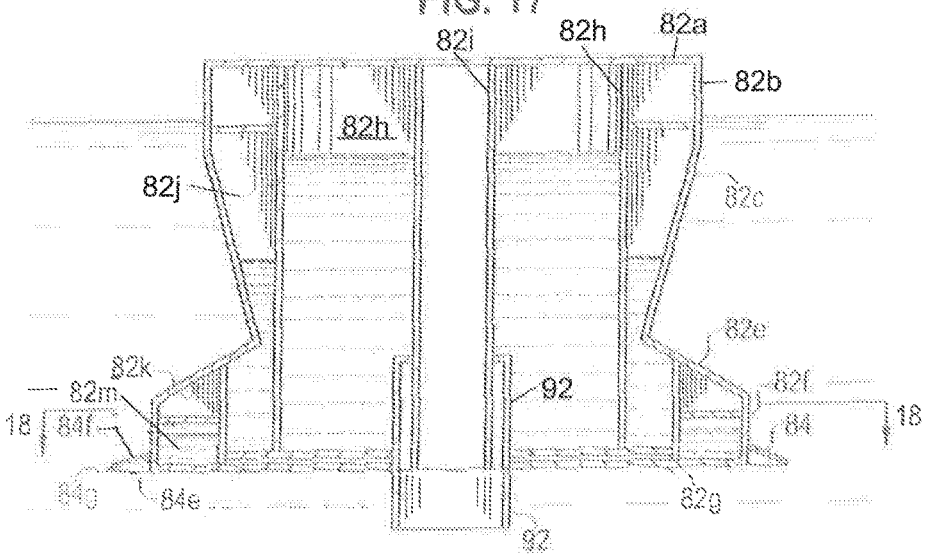
FIG. 17 is a cross section of the vessel of FIG. 15 as seen along the line 17-17 as shown in cross section.

FIG. 17 is the elevation of FIG. 15 in a vertical cross-section showing a simplified view of the tankage within hull 82 in cross-section. The produced resource flowing through production risers 90 is stored in an inner, annular tank 82*h*. A central vertical tank 82*i* can be used as a separator vessel, such as for separating oil, water and/or gas, and/or for storage. An outer, annular tank 82*j* having an outside wall conforming to the shape of upper conical section 82*c* and lower conical section 82*e* can be used to hold ballast water and/or to store the produced resource. In this embodiment, an outer, ring-shaped tank 82*k* is a void that has a cross-section of an irregular trapezoid defined on its top by lower conical section 82*e* and lower cylindrical section 82*f* with a vertical inner side wall and a horizontal lower bottom wall, although tank 82*k* could be used for ballast and/or storage. A torus-shaped tank 82*m*, which is shaped like a washer or doughnut having a square or rectangular cross-section, is located in a lowermost and outermost portion of hull 82. Tank 82*m* can be used for storage of a produced resource and/or ballast water. In one embodiment, tank 82*m* holds a slurry of hematite and water, and in a further embodiment, tank 82*m* contains about one part hematite and about three parts water.

Fins 84 for reducing heave arc shown in cross-section in FIG. 17. Each section of fins 84 has the shape of a right triangle in a vertical cross-section, where the 90° angle is located adjacent a lowermost outer side wall of lower cylindrical section 82*f* of hull 82, such that a bottom edge 84*e* of the triangle shape is co-planar with the bottom surface 82*g* of hull 82, and a hypotenuse 84*f* of the triangle shape extends from a distal end 84*g* of the bottom edge 84*e* of the triangle shape upwards and inwards to attach to the outer side wall of lower cylindrical section 82*f* at a point only slightly higher than the lowermost edge of the outer side wall of lower cylindrical section 82[, as can be seen in FIG. 17. Some experimentation may be required to size fins 84 for optimum effectiveness. A starting point is bottom edge 84*e* extends radially outwardly a distance that is about half the vertical height of lower cylindrical section 82*f*, and hypotenuse 84*f* attaches to lower cylindrical section 82*f* about one quarter up the vertical height of lower cylindrical section 82*f* from the bottom 82*g* of hull 82. Another starting point is that if the radius of lower cylindrical section 82*f* is R, then bottom edge 84*e* of fin 84 extends radially outwardly an additional 0.05 to 0.20 R, preferably about 0.10 to 0.15 R, and more preferably about 0.125 R.

Figure 18:
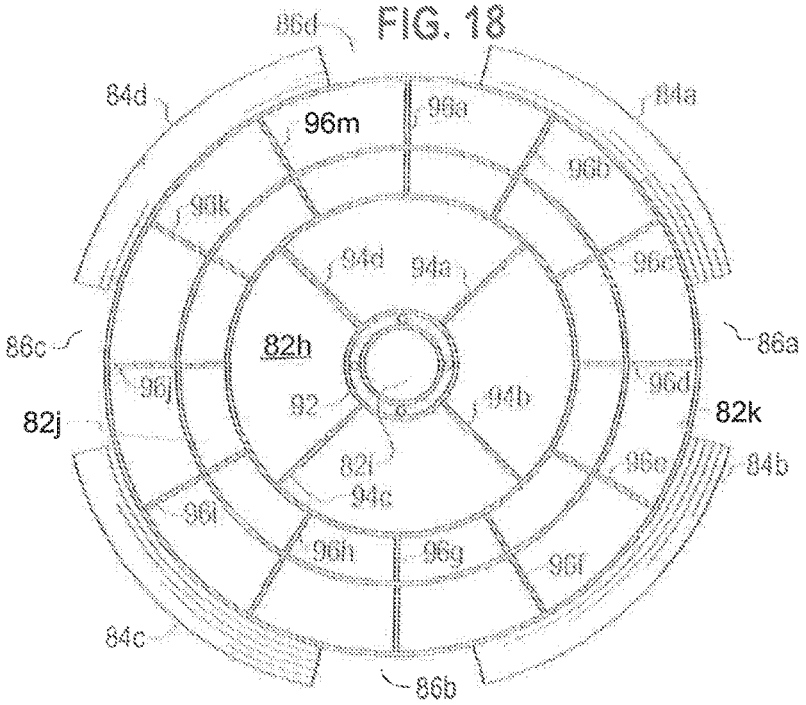
FIG. 18 is a cross section of the vessel of FIG. 15 as seen along the line 18-18 as shown in cross section.

FIG. 18 is a cross-section of hull 82 of MPSO and/or FPSO vessel 80 as seen along the line 18-18 in FIG. 17. Radial support members 94*a*, 94*b*, 94*c* and 94*d* provide structural support for inner, annular tank 82*h*, which is shown as having four compartments separated by the radial support members 94. Radial support members 96*a*, 96*b*, 96*c*, 96*d*, 96*e*, 96*f*, 96*g*, 96*h*, 96*i*, 96*j*, 96*k* and 96*m* provide structural support for outer, annular tank 82*j* and tanks 82*k* and 82*m*. Outer, annular tank 82*j* and tanks 82*k* and 82*m* are compartmentalized by the radial support members 96.

An FPSO vessel according to the present invention, such as FPSO vessels 10 and 80, can be made onshore, preferably at a shipyard using conventional ship-building materials and techniques. The FPSO vessel preferably has a circular shape in a plan view, but construction cost may favor a polygonal shape so that flat, planar metal plates can be used rather than bending plates into a desired curvature. An FPSO vessel hull having a polygonal shape with facets in a plan view, such as described in U.S. Pat. No. 6,761,508, issued to Haun and incorporated by reference, is included in the present invention. If a polygonal shape is chosen and if a moveable hawser connection is desired, then a tubular channel or rail can be designed with an appropriate radius of curvature and mounted with appropriate standoffs so as to provide the moveable hawser connection. If an FPSO vessel is built according to the description of FPSO vessel 10 in FIGS. 1-4, then it may be preferred to move the FPSO vessel, without a center column, to its final destination, anchor the FPSO vessel at its desired location, and install the center column offshore after the FPSO vessel has been moved and anchored in position. For the embodiment illustrated in FIGS. 7 and 9, it would likely be preferred to install the center column while the FPSO vessel is onshore, retract the center column to an uppermost position, and tow the FPSO vessel to its final destination with the center column installed by fully retracted. After the FPSO vessel is positioned at its desired location, the center column can be extended to a desired depth, and the mass trap on the bottom of the center column can be filled to help stabilize the hull against wind, wave and current action.

After the FPSO vessel is anchored and its installation is otherwise complete, it can be used for drilling exploratory or production wells, provided a derrick is installed, and it can be used for production and storage of resources or products. To offload a fluid cargo that has been stored on the FPSO vessel, a transport tanker is brought near the FPSO vessel.

With reference to FIGS. 1-4, a messenger line can be stored on reels 70*a* and/or 70*b*. An end of the messenger line can be shot with a pyrotechnic gun from FPSO vessel 10 to tanker T and grabbed by personnel on tanker T. The other end of the messenger line can be attached to a tanker end 18*c* (FIG. 2) of hawser 18, and the personnel on the tanker can pull hawser end 18*c* of hawser 18 to the tanker T, where it can be attached to an appropriate structure on tanker T. The personnel on tanker T can then shoot one end of the messenger line to personnel on the FPSO vessel, who hook that end of the messenger line to a tanker end 20*a* (FIG. 2) of hose 20. Personnel on the tanker can then pull tanker end 20*a* of hose 20 to the tanker and fasten it to an appropriate connection on the tanker for fluid communication between the FPSO vessel and the tanker. Typically, cargo will be offloaded from storage on the FPSO vessel to the tanker, but the opposite can also be done, where cargo from the tanker is offloaded to the FPSO vessel for storage.

Although the hose may be large, such as 20 inches in diameter, the hose hook-up and the offloading operation can take a long time, typically many hours but less than a day. During this time, the tanker T will typically weathervane downwind of the FPSO vessel and move about some as wind direction changes, which is accommodated on the FPSO vessel through the moveable hawser connection, allowing considerable movement of the tanker with respect to the FPSO, possibly through a 270-degree arc, without interrupting the offloading operation. In the event of a major storm or squall, the offloading operation can be stopped, and if desired, the tanker can be disconnected from the FPSO vessel by releasing hawser 18. After completion of a typical and uneventful offloading operation, the hose end 20*a* can be disconnected from the tanker, and a hose reel 20*b* can be used to reel hose 20 back into stowage on hose reel 20*b* on the FPSO vessel. A second hose and hose reel 72 is provided on the FPSO vessel for use in conjunction with the second moveable hawser connection 60 on the opposite side of FPSO vessel 10. Tanker end 18*c* of hawser 18 can then be disconnected, allowing tanker T to move away and transport the cargo it received to port facilities onshore. The messenger line can be used to pull tanker end 18*c* of hawser 18 back to the FPSO vessel, and the hawser can either float on the water adjacent the FPSO vessel, or the tanker end 18*c* of hawser 18 can be attached to a reel (not shown) on the deck 12*a* of FPSO vessel 10, and the hawser 18 can be reeled onto the reel for stowage on the FPSO, while dual ends 18*a* and 18*b* (FIG. 12) of hawser 18 remain connected to moveable hawser connection 40.

The invention relates to a method for operating floating vessel in a series of steps.

The method includes positioning a floating vessel at a first draft proximate a wellhead by floating.

The method includes ballasting the floating vessel to a second draft for drilling and production.

The method includes preparing the floating vessel at the second draft for drilling and production services offshore using a derrick/mast with a hoist, power supply, mud pumps, cement pumps, and a compensating system.

The method contemplates that the floating vessel usable in the method has a hull having: a bottom surface; a top deck surface; and at least two connected sections engaging between the bottom surface and the top deck surface.

The at least two connected sections of the hull are joined in series and symmetrically configured about a vertical axis with one of the at least two connected sections extending downwardly from the top deck surface toward the bottom surface.

The at least two connected sections have at least two of: an upper portion in section view with a sloping side extending from the top deck section; a cylindrical neck section in profile view; and a lower conical section in profile view with a sloping side extending from the cylindrical neck section; and at least one fin extending from the hull with an upper fin surface sloping towards the bottom surface and secured to and extending from the hull.

The at least one fin is configured to provide hydrodynamic performance through linear and quadratic damping, and wherein the lower conical section provides added mass with improved hydrodynamic performance through linear and quadratic damping to the hull, and wherein the floating vessel does not require a retractable center column to control pitch, roll and heave.

The method includes the step of forming a drill string and lowering a drill bit connected to the drill string through a marine riser to a sea floor and passing through a plurality of sequentially connected safety valves using the hull described above.

The method includes the step of upon reaching a pay zone of a reservoir, removing the drill bit and the drill string and preparing the reservoir for production using the hull described above.

The method includes the step of moving the floating vessel to another location for additional drilling and production services offshore.

Embodiments of the method contemplate that the hull has a shape inscribed within a circle.

Embodiments of the method further include the step of: installing additional mass in the at least one fin to improve at least one of: heave control and roll control of the floating vessel.

Embodiments of the method further include the step of: installing mass on the hull at a predefined location, the mass having predefined shapes to overcome an overturning moment, increasing hull displacement and reducing slow varying wave drift of the floating vessel, wherein the slow varying wave drift comprises velocity induced by current speed on the floating vessel.

Embodiments of the method include forming the lower conical section from a plurality of sloping connected sides, each sloping connected side having at least one of identical angles for each sloping side and different angles for each sloping side.

Embodiments of the method contemplate installing additional sloping sides between the plurality of sloping connected sides.

Embodiments of the method contemplate installing a plurality of segmented fins aligned with each other and attached circumferentially around the hull.

Embodiments of the method involve forming a planar face on the at least one fin in parallel with a vertical axis of the floating vessel.

Embodiments of the method include forming a recess in the hull and wherein the recess is a moon pool.

Embodiments of the method involve using a tapered plate extending the hull.

Embodiments of the method contemplate that the polygonal shape of the hull is formed from a plurality of fiat planar metal plates which are connected so as to form a curvature of the hull.

Embodiments of the method involve forming at least one tank in the at least one fin.

Embodiments of the method involve installing an extending bottom edge from the at least one fin on a circumference of the bottom surface decreasing hull motion.

Specific structural and functional details disclosed herein are not to be interpreted as limiting, but merely as a basis of the claims and as a representative basis for teaching persons having ordinary skill in the art to variously employ the present invention.

While these embodiments have been described with emphasis on the embodiments, it should be understood that within the scope of the appended claims, the embodiments might be practiced other than as specifically described herein.

What is claimed is:

1. A method for operating a floating vessel comprising:

a. positioning the floating vessel at a first draft proximate a wellhead by floating;

b. ballasting the floating vessel to a second draft for drilling and production;

c. preparing the floating vessel at the second draft for drilling and production services offshore using a derrick/mast with a hoist, power supply, mud pumps, cement pumps, and a compensating system, wherein the floating vessel comprises a hull having:

i. a bottom surface;

ii. a top deck surface; and iii. at least two connected sections engaging between the bottom surface and the top deck surface, the at least two connected sections joined in series and symmetrically configured about a vertical axis with one connected section of the at least two connected sections extending downwardly from the top deck surface toward the bottom surface, the at least two connected sections comprising at least two of: an upper portion in section view with a sloping side extending from the top deck surface; a cylindrical neck section in profile view; and a lower conical section in profile view with a sloping side extending from the cylindrical neck section; and iv. at least one fin extending from the hull with an upper fin surface sloping towards the bottom surface and secured to and extending from the hull, the at least one fin configured to provide hydrodynamic performance through linear and quadratic damping, and wherein the lower conical section provides added mass with improved hydrodynamic performance through linear and quadratic damping to the hull, and wherein the floating vessel does not require a retractable center column to control pitch, roll and heave;

d. forming a drill string and lowering a drill bit connected to the drill string through a marine riser to a sea floor and passing through a plurality of sequentially connected safety valves;

e. upon reaching a pay zone of a reservoir, removing the drill bit and the drill string and preparing the reservoir for production; and f. moving the floating vessel to another location for additional drilling and production services offshore.

2. The method of claim 1, wherein the hull is a shape inscribed within a circle.

3. The method of claim 1, further comprising the step of: installing additional mass in the at least one fin to improve at least one of: heave control and roll control of the floating vessel.

4. The method of claim 1, further comprising the step of: installing mass on the hull at a predefined location, the mass having predefined shapes to overcome an overturning moment, increasing hull displacement and reducing slow varying wave drift of the floating vessel, wherein the slow varying wave drift comprises velocity induced by current speed on the floating vessel.

5. The method of claim 1, comprising forming the lower conical section from a plurality of sloping connected sides; each sloping connected side plurality of sloping connected sides, having at least one of: identical angles for each sloping side and different angles for each sloping side.

6. The method of claim 5, comprising installing additional sloping sides between the plurality of sloping connected sides.

7. The method of claim 1, comprising installing a plurality of segmented fins aligned with each other and attached circumferentially around the hull.

8. The method of claim 1, comprising forming a planar face on the at least one fin in parallel with a vertical axis of the floating vessel.

9. The method of claim 1, comprising forming a recess in the hull and wherein the recess is a moon pool.

10. The method of claim 1, comprising using a tapered plate extending the hull.

11. The method of claim 1, wherein the polygonal shape of the hull comprises a plurality of flat planar metal plates forming a curvature of the hull.

12. The method of claim 1, comprising forming at least one tank in the at least one fin.

13. The method of claim 1, comprising installing an extending bottom edge from the at least one fin on a circumference of the bottom surface decreasing hull motion.

* * * * *